US005170738A

United States Patent [19]

Patten

[11] Patent Number: 5,170,738

[45] Date of Patent: Dec. 15, 1992

[54] INFLATABLE BOAT FOR SCUBA OPERATIONS

[76] Inventor: Robert F. Patten, 7640 St. Andrews Rd., Lakeworth, Fla. 33467

[21] Appl. No.: 637,285

[22] Filed: Jan. 3, 1991

[51] Int. Cl.[5] ..... B63B 7/00

[52] U.S. Cl. ..... 114/345; 114/362

[58] Field of Search ..... 114/315, 345, 348, 349, 114/362, 363; 441/35, 38, 39, 40–42, 129–132, 136

[56] References Cited

U.S. PATENT DOCUMENTS

| | | | |
|---|---|---|---|
| 3,131,406 | 5/1964 | Cousteau et al. | 441/40 |
| 3,791,327 | 2/1974 | Deveney | 114/315 |
| 4,909,177 | 3/1990 | Jones | 114/345 |

FOREIGN PATENT DOCUMENTS

| | | | |
|---|---|---|---|
| 0070591 | 3/1990 | Japan | 114/345 |

*Primary Examiner*—Edwin L. Swinehart

[57] ABSTRACT

An inflatable vessel for marine divers having an opening in the fabric bottom or deck to enable divers to board the vessel from the water through the opening without swamping the vessel. No rigid framework is required.

2 Claims, 1 Drawing Sheet

INFLATABLE BOAT FOR SCUBA OPERATIONS

BACKGROUND OF THE INVENTION

1. Field of the Invention

The present invention relates to an inflatable vessel designed for use by underwater swimmers and scuba divers.

2. Prior Art

Existing vehicles available for use in similar operations are either (a) totally rigid, or (b) partially rigid with an inflatable tube supporting a rigid frame which forms a well for entry, or (c) completely inflatable without an access opening in the bottom, requiring the diver to board by climbing over the inflated tube, a difficult feat particularly when burdened with scuba gear. The decks or bottoms of existing vehicles are not necessarily suspended above the waterline which is a requirement of this invention to prevent flooding of the interior when the cover over the access opening is removed.

SUMMARY OF THE INVENTION

It is the object of this invention to provide personnel engaged in underwater activities with a vessel to transport them to their area of operations, which vessel is collapsible because of its inflatable structure rendering it readily portable and which provides egress and ingress through the bottom of the vessel. This is accomplished by suspending the bottom of the inflatable boat between the juncture of two inflatable tubes, one tube superimposed upon the other, the lower tube of such volume that the lower tube will displace sufficient water to provide the buoyancy necessary to keep the bottom above water when the vessel is loaded to its rated capacity.

DESCRIPTION OF THE PREFERRED EMBODIMENT

Figure 1:
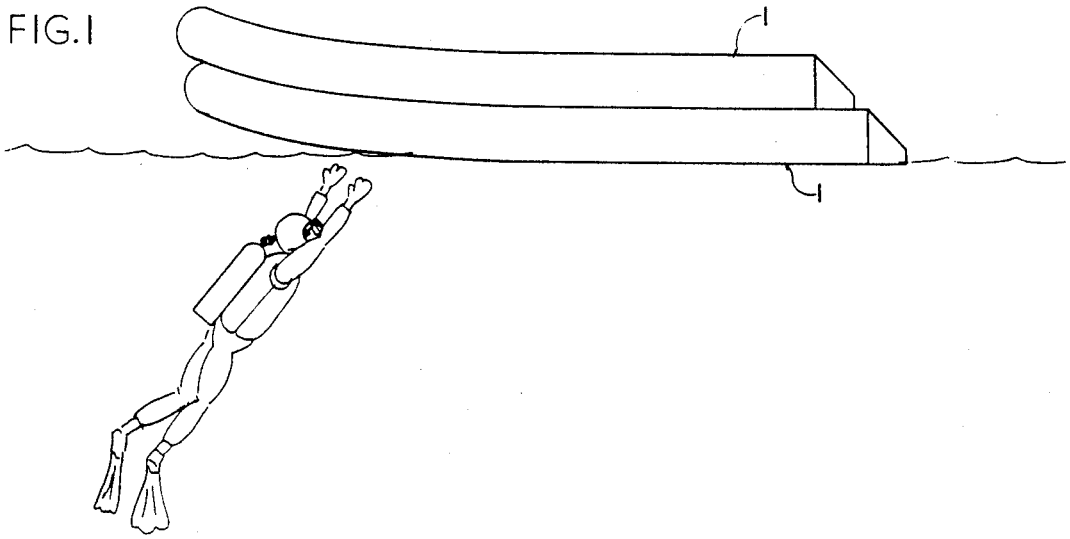
FIG. 1 is a view of an inflatable boat with scuba diver approaching for re-entry into the boat.
Figure 2:
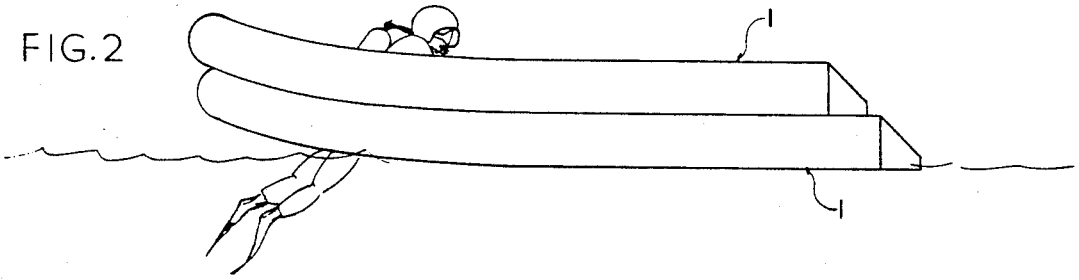
FIG. 2 shows the diver entering the boat through the opening in the bottom shown in FIG. 3.
Figure 3:
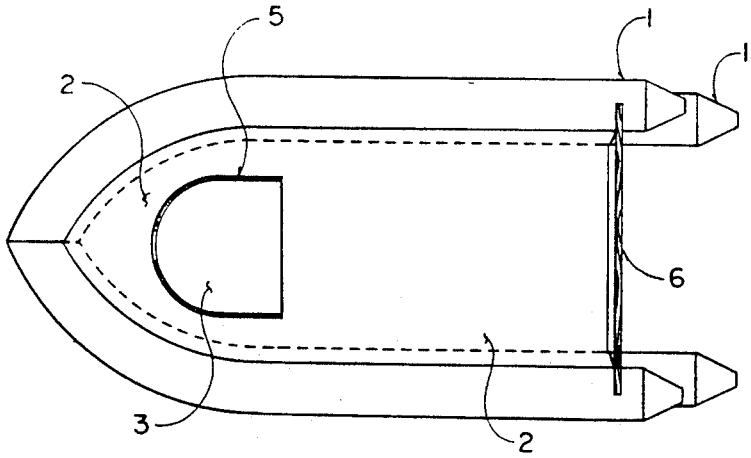
FIG. 3 is a view inboard showing the opening through the deck.
Figure 4:
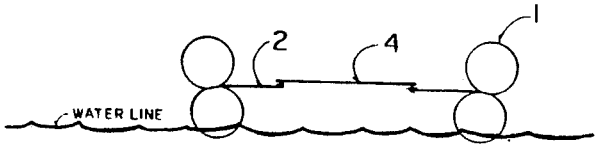
FIG. 4 is a cross-sectional view showing the suspended deck with cover flap closed.

Referring now to FIGS. 1, 2, 3, and 4, the preferred embodiment of the invention is an inflatable boat formed by two inflatble tubes, one superimposed upon the other 1, with a fabric bottom 2 suspended between the two tubes, and with an access opening in the bottom 3 covered with a removable fabric cover 4, with means 5 for attaching the cover to the bottom. A transom 6 is shown but is not pertinent to the claim. Various modifications and changes may be made with respect to the foregoing without departing from the spirit of the invention.

What is claimed is:

1. A marine diving vessel comprising:

two inflatable tubes, one superimposed upon the other to form an upper and lower tube; a fabric bottom suspended between the juncture of the two tubes;

the bottom held above the water level by the buoyancy of the lower tube;

the bottom containing an opening through which a diver can board the boat without swamping the interior of the boat without the requirement of a wall above the bottom to prevent flooding.

2. A marine diving vessel as set forth in claim 1, with the opening in the bottom covered by a fabric cover with means provided to permit opening the cover to allow divers to enter the vessel and to permit closing of the cover when not in use as an entry port.

* * * * *